US006221227B1

(12) United States Patent
Lin et al.

(10) Patent No.: US 6,221,227 B1
(45) Date of Patent: Apr. 24, 2001

(54) MICROFABRICATION PROCESS FOR MAKING MICROSTRUCTURES AS GEOMETRICALLY MINIATURIZED FROM THREE-DIMENSIONAL ORIENTATIONS

(76) Inventors: Ching-Bin Lin, 2F-2, No. 12, Lane 88, Min-Sheng E. Road, Sec. 3, Taipei (TW), 104; Shung-Wen Kang, 8F, No. 568-1, Kuang-fu S. Road, Taipei; Mau-Kuo Wei, 11F, No. 14, Lane 31, Kuo-Kuang Road, Panchiao, Taipei Hsien, both of (TW)

( * ) Notice: Subject to any disclaimer, the term of this patent is extended or adjusted under 35 U.S.C. 154(b) by 0 days.

(21) Appl. No.: 09/454,066

(22) Filed: Nov. 2, 1999

(51) Int. Cl.[7] ..... C25D 1/00
(52) U.S. Cl. ..... 205/67; 205/205
(58) Field of Search ..... 205/67 OR, 70, 205/159, 205, 14

(56) References Cited

U.S. PATENT DOCUMENTS

| | | | | |
|---|---|---|---|---|
| 5,501,784 | * | 3/1996 | Lessmollmann et al. | 205/67 |
| 5,529,681 | * | 6/1996 | Reinecke et al. | 205/70 |
| 5,792,595 | * | 8/1998 | Takayanagi et al. | 430/325 |
| 5,863,666 | * | 1/1999 | Merchant et al. | 428/544 |
| 5,944,974 | * | 8/1999 | Fahrenberg et al. | 205/70 |

* cited by examiner

*Primary Examiner*—Kathryn Gorgos
*Assistant Examiner*—Erica Smith-Hicks

(57) ABSTRACT

A microfabrication process comprises the swelling of at least a hydrophilic polymer in order for shrinking each cavity size of a micromachined microstructure pattern from three-dimensional orientations, whereby upon filling or deposition of metal into each cavity of the pattern when performing an electroforming step, a supermini microstructure with slim, fine, thin and small size can be obtained as geometrically miniaturized from three-dimensional orientations.

4 Claims, 2 Drawing Sheets

MICROFABRICATION PROCESS FOR MAKING MICROSTRUCTURES AS GEOMETRICALLY MINIATURIZED FROM THREE-DIMENSIONAL ORIENTATIONS

BACKGROUND OF THE INVENTION

This application is an improvement of the application early filed on: Oct. 15, 1999 by one (i.e. Ching-Bin Lin) of the co-inventors of this application, which is entitled: "Microfabrication Process for Making Microstructures Having High Aspect Ratio" given with Ser. No. 09/422,092 pending.

The steps of microfabrication process of the earlier application (09/422,092) are summarized as follows:

"a. preparing an electrolyte solution to be filled in an electroforming system;

b. forming an electrically insulative masking thin film on a polymer substrate;

c. micromachining the substrate for forming three-dimensional microstructure pattern with deep cavities;

d. shrinking the width or diameter of each cavity of the microstructure pattern by steadily swelling the polymer, which is prefixed on a cathode of the electroforming system, by saturating the electrolyte solution into the polymer;

e. electroforming in the electroforming system electrically connected with an anode and the cathode for filling metal in the cavities in the polymer; and f. desorption of the electrolyte from the polymer to shrink the polymer to be separated from an electroformed microstructure product, and demolding for obtaining the microstructure product having a high aspect ratio of 100 or even higher."

However, such a microfabrication process may only produce microstructures of simple geometric structures, for instance, a slim column as shown in FIG. 11 with numeral "15". There is no disclosure of the methods for making microstructures with complex three-dimensional geometric configurations for diversified end uses.

The present inventor has found that the theoretical background of the earlier application may provide a basis for further developing the microfabrication field and invented the present microfabrication process for geometrically miniaturizing a microstructure from three-dimensional orientations.

SUMMARY OF THE INVENTION

The object of the present invention is to provide a microfabrication process comprising the swelling of at least a hydrophilic polymer in order for shrinking each cavity size of a micromachined microstructure pattern from three-dimensional orientations, whereby upon filling or deposition of metal into each cavity of the pattern when performing an electroforming step, a supermini microstructure with slim, fine, thin and small size can be obtained as geometrically miniaturized from three-dimensional orientations.

DETAILED DESCRIPTION

Figure 1:
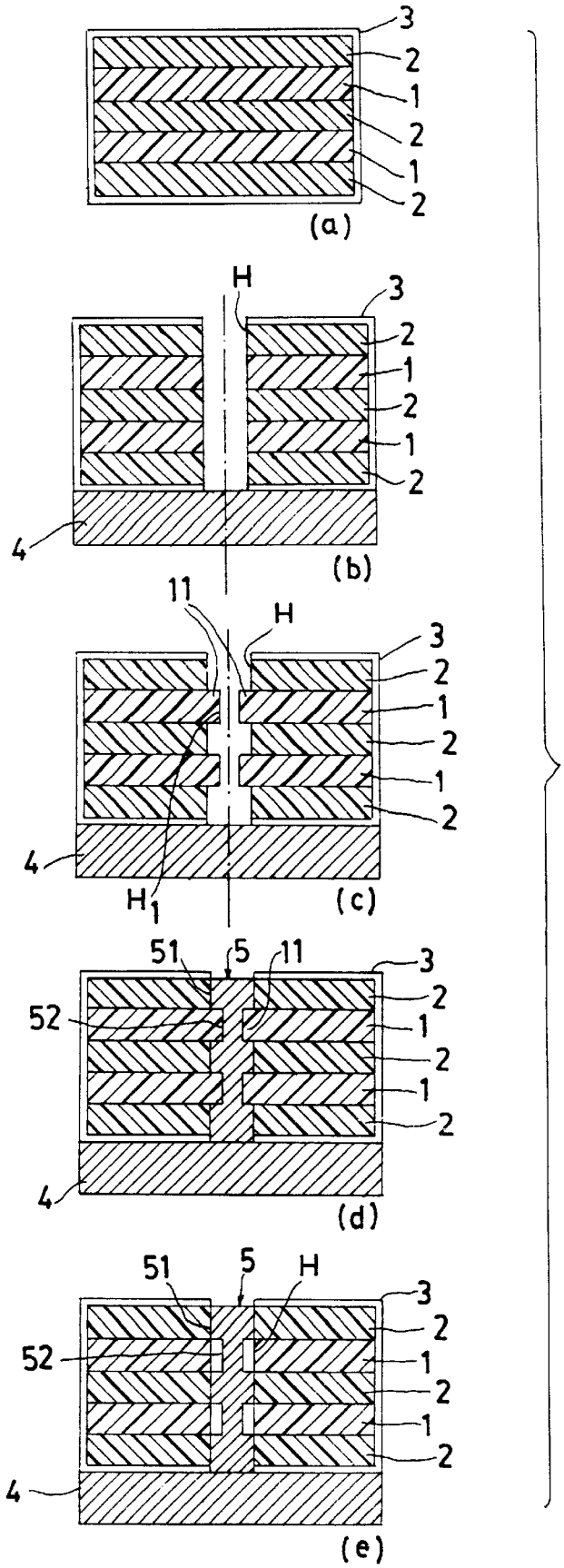
FIG. 1 shows the process steps a–e in accordance with the present invention.
Figure 2:
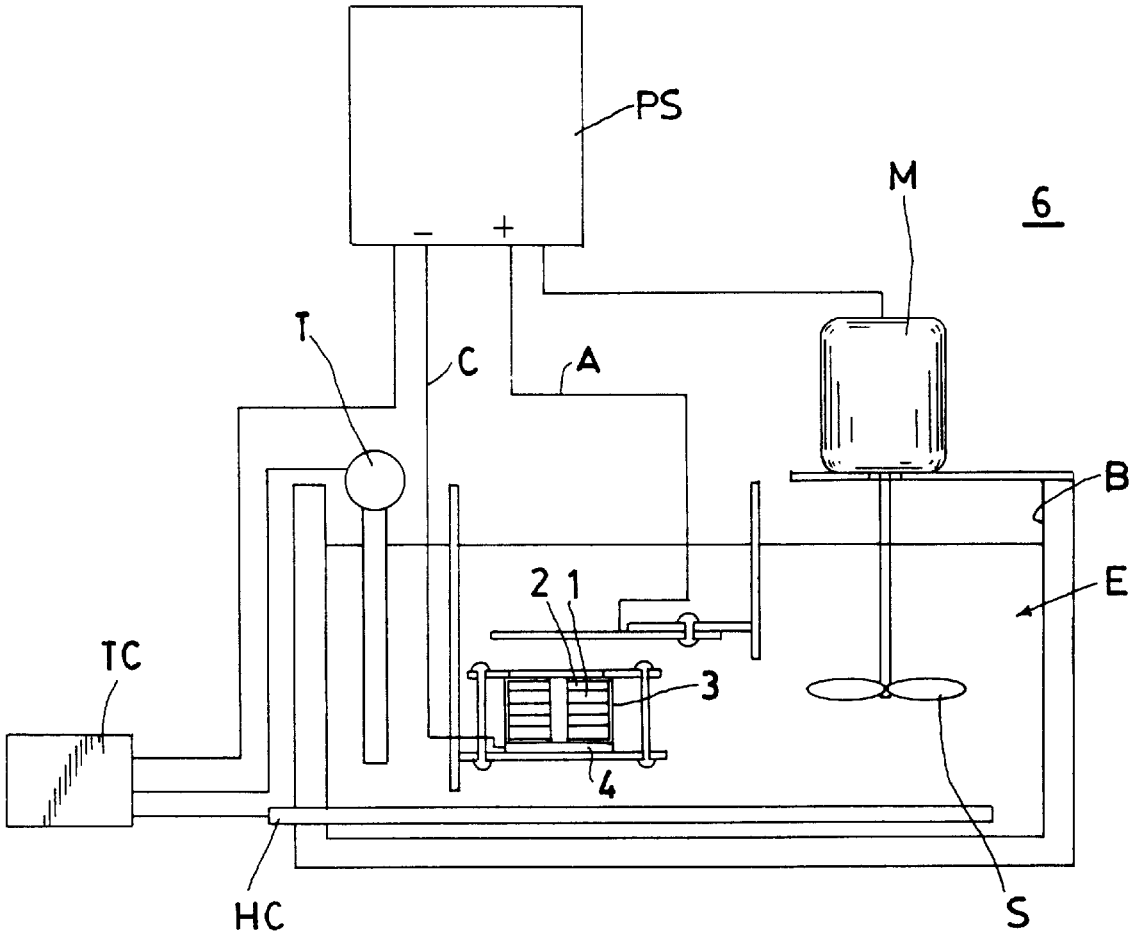
FIG. 2 is an illustration of an electroforming system as used in the present invention.

As shown in FIGS. 1 and 2, the microfabrication process of the present invention comprises the steps of:

1. An electrolyte solution E is prepared to be filled into a bath B of an electroforming system 6 as shown in FIG. 2. The electroforming system 6 is adapted for conducting electroforming process which will be described in detail hereinafter.

2. A first layer of hydrophilic polymer 1, capable of massively absorbing the electrolyte solution containing large aqueous solution, is coated on a first layer of hydrophobic resin 2, which is cured and unable for absorbing the electrolyte solution. After the first layer of hydrophilic polymer 1 is vaporized and cured due to cross linking, another (or second) layer of hydrophobic resin 2 is closely superimposed on the first layer of hydrophilic polymer 1. Still, further (or second) layer of hydrophilic polymer 1 is then coated on the second layer of hydrophobic resin 2, thereby forming a multiple-layer composite laminate by repeatedly superimposing plural laminate units each consisting of a layer of hydrophilic polymer 1 with a layer of hydrophobic resin 2, such as the arrangement of numerals "2-1-2-1-2" (from bottom to top) as shown in FIG. 1.

The hydrophilic polymer 1 may be selected from hydrophilic polyurethane (PU), hydrophilic polymethyl methacrylate (PMMA), etc.

The hydrophobic resin 2 may be selected from hydrophobic resins of epoxy, polytetrafluoro ethylene (Teflon), high-density polyethylene (HDPE), polypropylene (PP), polycarbonate (PC), etc.

Then all the outer surfaces of the parallelepiped composite laminate are conducted for surface treatment including flattening, polishing and cleaning. A thin protective masking film 3 is then circumferentially formed or coated on the outer surfaces of the parallelepiped composite laminate as shown in FIG. 1(*a*). The masking film 3 is electrically insulative. The masking film 3 should preclude penetration or mass transfer of the electrolyte into the interior of the polymer 1 (except the pattern cavity H as formed in the polymer). The film 3 may also not be debonded by or dissolved in the electrolyte solution during the subsequent mass transport saturation or electroforming steps.

3. By using micromachining tools or methods, a plurality of cavities H of a microstructure pattern may be drilled in the composite laminate. Each cavity H having a diameter of 400 microns may be drilled by using 193 nm laser beam.

The drilled or micromachined composite laminate is then closely joined on a cathode plate 4, e.g., a cathode nickel plate as shown in FIG. 1(*b*). For clear illustration, there is only a cavity H as shown in FIG. 1.

4. The micromachined composite laminate as joined with the cathode plate 4 is dipped in the electrolyte E of the electroforming system 6. The temperature and the composition of the electrolyte E in the mass transport step are the same as that applied in electroforming step as hereinafter described.

The electrolyte solvent will diffuse into the interior of the polymer 1 through the cavities H by mass transport of the electrolyte solvent for swelling the polymer 1 at the micromachined portions 11 each disposed around each cavity as shown in FIG. 1(*c*). As the swelling of the polymer 1, the diameter or width of each cavity is then shrunk to be finer (from H to H1) as shown in FIG. 1(*c*).

When the electrolyte is diffused into the hydrophilic polymer 1 by mass transport, the molecules of the electrolyte solvent will enter the interior of the hydrophilic polymer to separate the molecular chains of the polymer having larger distance between the adjacent molecular chains, thereby swelling the polymer. When the potential energy of the chemical mass transport is balanced with the mechanical stress as induced by the swelling of the polymer, the mass transport phenomenum will reach equilibrium to maintain a constant value of the swelling size of the polymer.

Comparatively, there is no swelling caused by the hydrophobic resin 2 since it will not absorb the electrolyte E. At the boundary or interface between the hydrophilic polymer 1 and the hydrophobic resin 2, a constrained swelling will not occur because the hydrophobic resin 2 is closely superimposed with the hydrophilic polymer 1, but not interactively bonded with cross linking between the polymer 1 and the resin 2. So, the swelling will occur homogeneously equidistantly from the polymer towards the center of the cavity H.

5. The laminate having swelled polymer 1, in which the cavities have been filled with the electrolyte, is now subjected to electroforming step [FIG. 1(*d*)] in the electroforming system.

The electroforming system 6 as shown in FIG. 2 includes: a bath B filled therein with the electrolyte solution E, a power supply PS having an anode A and a cathode C electrically connected to the cathode nickel plate 4 which has been already joined with the laminate containing the swelled polymer 1, a stirrer S secured to a DC motor M with variable rotation speed for homogeneously agitating the electrolyte solution E in the bath B, a heating coil HC formed in the bath for heating the electrolyte solution to a proper temperature which is kept constant by a temperature controller TC and a sensor T. Any gas bubbles existing in the cavities may be expelled outwardly as purged by the electrolyte solution.

The power supply PS provides the suitable current and voltage for conducting the electroforming step for electrodeposition of the metal in each cavity in the laminate until filling the cavities in the laminate to the predetermined height or depth. Then, the power supply PS is disconnected.

The metals or alloys which may be electrodeposited in the electroforming step include: nickel, copper, silver, nickel-phosphor alloy, nickel-iron-phosphor alloy, nickel-titanium alloy, nickel-titanium-phosphor alloy, etc.

6. After deposition or filling of metal into the pattern cavity till a desired height or depth, the power supply PS is disconnected and the composite laminate is then removed from the electroforming system 6. The swelled polymer is heated to cause desorption of the electrolyte already saturated in the polymer 1 so as to shrink and recover the polymer to its original size as shown in FIG. 1(*e*).

The polymer 1 is shrunk to be separated from the electroforming microstructure product 5. The electroforming microstructure product 5 is then demolded and separated from the laminated polymer 1 and resin 2. Due to the swelling (11) of the polymer 1 to shrink the size (diameter or width H1) of the pattern cavity, the electroforming microstructure 5 will form a slimmer, finer or smaller diameter or width 52, thereby causing a high aspect ratio of the microstructure product 5.

The electroforming microstructure product 5 includes a disk portion 51 having a large diameter because there is no swelling of the hydrophobic resin 2 and no shrinking of the cavity H adjacent the hydrophobic resin layer; and a neck portion 52 having a small diameter because the swelling of hydrophilic polymer 1 will shrink the cavity to be smaller (H1). So, a multiple-layer microstructure will be obtained having plural disk members coaxially integrally formed on a shaft or axle corresponding to the neck portions 52. For instance, the disk portion 51 may be referred to a spur gear, while the neck portion 52 may be referred to a transmission shaft. Other modifications can be made in accordance with the present invention. For example, multiple pulleys may be coaxially linked about a driving shaft.

Accordingly, many three-dimensional miniaturized microstructures with interesting diversified geometric configurations may be obtained in accordance with the present invention to be superior to any prior art which may make microstructures of simple geometric shapes only. The present invention comprehensively explores the microfabrication field.

We claim:

1. A microfabrication process comprising the steps of:

A. preparing an electrolyte solution adapted to be filled in an electroforming system for electroforming step;

B. coating a hydrophilic polymer, capable of absorbing a solvent of the electrolyte solution to be swelled by the solvent, on a cured hydrophobic resin, unable for absorbing the solvent of the electrolyte solution for forming a composite laminate unit consisting of a layer of hydrophobic resin and a layer of hydrophilic polymer; closely superimposing a plurality of the composite laminate units to form a multiple-layer composite laminate by repeatedly alternatively superimposing one layer of said hydrophilic polymer on one layer of said hydrophobic resin; and coating a thin electrically insulatvie masking film on all outer surfaces of said multiple-layer composite laminate after surface treatment thereof;

C. micromachining said multiple-layer composite laminate for forming a three-dimensional microstructure pattern with a plurality of cavities formed through the composite laminate; and closely joined with a cathode plate;

D. dipping said composite laminate as micromachined in said electrolyte solution in said electroforming system to allow mass transport of said solvent of the electrolyte solution into said polymer of said composite laminate for swelling said polymer for shrinking a size of each said cavity in said polymer;

E. electroforming in said electroforming system for filling metal and alloy into the cavities in said composite laminate already swelled as saturated by said electrolyte solution;

F. desorption by heating of said electrolyte solution from said polymer as swelled for shrinking and recovering said polymer for separating a multiple-layer microstructure product from said composite laminate for obtaining said multiple-layer microstructure product having high aspect ratio.

2. A process according to claim 1, wherein said hydrophilic polymer includes: hydrophilic polyurethane, and hydrophilic polymethyl methacrylate.

3. A process according to claim 1, wherein said hydrophobic resin includes: epoxy, polytetrafluoro ethylene, high-density polyethylene, polypropylene, and polycarbonate.

4. A process according to claim 1, wherein said metal and alloy used for electroforming includes: nickel, copper, silver, nickel-phosphor alloy, nickel-titanium-phosphor alloy, nickel-iron-phosphor alloy, or nickel-titanium alloy.

* * * * *